US009810077B2

(12) United States Patent
Murdock et al.

(10) Patent No.: US 9,810,077 B2
(45) Date of Patent: Nov. 7, 2017

(54) FAN BLADE ATTACHMENT OF GAS TURBINE ENGINE

(75) Inventors: James R. Murdock, Tolland, CT (US); Christopher S. McKaveney, Rocky Hill, CT (US); Jason Elliott, Huntington, IN (US)

(73) Assignee: United Technologies Corporation, Farmington, CT (US)

( * ) Notice: Subject to any disclaimer, the term of this patent is extended or adjusted under 35 U.S.C. 154(b) by 677 days.

(21) Appl. No.: 13/362,057

(22) Filed: Jan. 31, 2012

(65) Prior Publication Data

US 2013/0195669 A1 Aug. 1, 2013

(51) Int. Cl.
*F01D 5/30* (2006.01)

(52) U.S. Cl.
CPC ..... *F01D 5/3007* (2013.01); *F05D 2220/36* (2013.01); *F05D 2250/131* (2013.01); *F05D 2250/14* (2013.01); *F05D 2250/141* (2013.01)

(58) Field of Classification Search
CPC ..... F01D 5/22; F01D 5/30; F01D 5/32; F01D 5/3007; B64C 27/46
USPC ..... 416/193 A, 204 R, 204 A, 212 R, 212 A, 416/219 R, 220 R, 244 R, 244 A, 223 R, 416/248
See application file for complete search history.

(56) References Cited

U.S. PATENT DOCUMENTS 3,687,569 A 8/1972 Klompas
4,170,874 A 10/1979 Kyrklund
4,228,753 A 10/1980 Davis et al.
4,232,516 A 11/1980 Lewis et al.
4,453,890 A * 6/1984 Brantley ..... 416/220 R
4,516,561 A 5/1985 Stawski et al.
4,998,409 A 3/1991 Mutch
5,054,713 A 10/1991 Langley et al.
5,129,225 A 7/1992 Tonks
5,197,191 A 3/1993 Dunkman et al.
5,281,062 A 1/1994 Dunkman et al.
5,443,367 A 8/1995 Samit et al.
5,490,485 A 2/1996 Kutlucinar
5,540,552 A 7/1996 Surdi
(Continued)

FOREIGN PATENT DOCUMENTS

DE 19705323 A1 8/1998
EP 1355044 A2 10/2003
(Continued)

OTHER PUBLICATIONS

International Search Report for PCT Application No. PCT/US2013/23155 dated Aug. 29, 2013.
(Continued)

*Primary Examiner* — Craig Kim
*Assistant Examiner* — Maxime Adjagbe
(74) *Attorney, Agent, or Firm* — Carlson, Gaskey & Olds, P.C.

(57) ABSTRACT

A fan blade includes a root including a front surface, a rear surface, a first side surface connected to the front surface and the rear surface, and a second side surface connected to the front surface and the rear surface. The front surface engages the first side surface and the second side surface by one or more blunted surfaces, and the rear surface engages the first side surface and the second side surface by one or more blunted surfaces. A blade extends from the root.

28 Claims, 5 Drawing Sheets

(56) References Cited

U.S. PATENT DOCUMENTS

| | | | | |
|---|---|---|---|---|
| 5,800,121 | A | 9/1998 | Fanelli | |
| 5,836,744 | A | 11/1998 | Zipps et al. | |
| 5,996,336 | A | 12/1999 | Hamedani | |
| 6,004,101 | A | 12/1999 | Schilling et al. | |
| 6,146,099 | A | 11/2000 | Zipps et al. | |
| 6,490,865 | B2 | 12/2002 | Pauly | |
| 6,497,550 | B2 | 12/2002 | Booth | |
| 6,840,028 | B2 | 1/2005 | Firdaus | |
| 7,070,391 | B2 | 7/2006 | Weisse | |
| 7,134,631 | B2 | 11/2006 | Loth | |
| 7,306,045 | B1 | 12/2007 | Moflihi | |
| 7,694,505 | B2 | 4/2010 | Schilling | |
| 7,730,714 | B2 | 6/2010 | Wood et al. | |
| 7,744,346 | B2 | 6/2010 | Schreiber et al. | |
| 7,993,105 | B2 | 8/2011 | Weisse et al. | |
| 8,033,092 | B2 | 10/2011 | Suciu et al. | |
| 2002/0044870 | A1* | 4/2002 | Simonetti et al. | 416/221 |
| 2008/0187441 | A1 | 8/2008 | Schreiber | |
| 2009/0185910 | A1* | 7/2009 | McLaughlan et al. | 416/223 R |

FOREIGN PATENT DOCUMENTS

| | | |
|---|---|---|
| EP | 0905509 | 9/2009 |
| EP | 1312756 | 2/2011 |

OTHER PUBLICATIONS

Gunston, Bill, "Jane's Aero-Engines," Issue Seven, 2000, pp. 510-512.

International Preliminary Report on Patentability for PCT Application No. PCT/US2013/023155 dated Aug. 14, 2014.

European Search Report for EP Application No. 13777576.3 dated Nov. 4, 2015.

Search Report and Written Opinion for Singapore Application No. 11201403113Y dated Jun. 2, 2015.

* cited by examiner

FAN BLADE ATTACHMENT OF GAS TURBINE ENGINE

BACKGROUND OF THE INVENTION

A gas turbine engine includes a fan section that drives air along a bypass flowpath. The fan section includes a fan rotor that includes a plurality of slots. A fan blade includes a root and a blade. Each of the plurality of slots is sized and shaped to receive the root of one of the fan blades.

A base of the root of the fan blade includes a front surface and a rear surface that are substantially flat and flush with a face of the fan rotor. The root also includes two side surfaces, which can be straight or curved. The front surface, the rear surface, and the side surfaces are connected to a bottom surface. The intersection of each of the side surfaces with each of the front surface and the rear surface defines an edge.

A cross-sectional area of the root taken substantially parallel to the bottom surface defines a perimeter having four corners, each of the corners defining part of the edge. The edges where the side surfaces meet the front surface and the rear surface are high stress areas and can be subject to handling damage. If any damage occurs, the local concentrated stress can increase significantly.

Additionally, the root cannot be treated with aggressive surface treatments, such of deep-peening, low plasticity burnishing or laser shock peening, as the edges of the root could be deformed by these aggressive treatments.

SUMMARY OF THE INVENTION

A fan blade according to an exemplary aspect of the present disclosure includes, among other things, a root including a front surface, a rear surface, a first side surface connected to the front surface and the rear surface, and a second side surface connected to the front surface and the rear surface. The front surface engages the first side surface and the second side surface by one or more blunted surfaces, and the rear surface engages the first side surface and the second side surface by one or more blunted surfaces. A blade extends from the root.

In a further non-limited embodiment of the foregoing fan blade embodiment, the fan blade may include a front surface and a rear surface that are substantially flat.

In a further non-limited embodiment of any of the foregoing fan blade embodiments, the fan blade may include a cross-section of the root taken substantially parallel to a bottom surface of the root including no angles.

In a further non-limited embodiment of any of the foregoing fan blade embodiments, the fan blade may include blunted surfaces having a radius.

In a further non-limited embodiment of any of the foregoing fan blade embodiments, the fan blade may include a radius that is between about 0.1 inch to about 0.6 inch.

In a further non-limited embodiment of any of the foregoing fan blade embodiments, the fan blade may include blunted surfaces that are an ellipse.

In a further non-limited embodiment of any of the foregoing fan blade embodiments, the fan blade may include blunted surfaces that are a chamfer.

In a further non-limited embodiment of any of the foregoing fan blade embodiments, the fan blade may include a front surface and a rear surface that are curved.

In a further non-limited embodiment of any of the foregoing fan blade embodiments, the fan blade may include a first side surface and the second side surface that are substantially straight.

In a further non-limited embodiment of any of the foregoing fan blade embodiments, the fan blade may include a first side surface and a second side surface are substantially curved.

In a further non-limited embodiment of any of the foregoing fan blade embodiments, the fan blade may be made of at least one of aluminum and titanium.

In a further non-limited embodiment of any of the foregoing fan blade embodiments, the fan blade may include a root including a portion having substantially parallel walls defining a width therebetween. A distance may be defined between an outer edge of the portion of the root and a line that extends substantially parallel to the outer edge. The line passes through a point where the front surface and a first blunted surface meet and a point where the rear surface and a second blunted surface meet. A ratio of the distance to the width may be between about 0.15 to about 0.50.

A turbine engine according to another exemplary aspect of the present disclosure includes, among other things, a compressor section, a combustor in fluid communication with the compressor section, a turbine section in fluid communication with the combustor, and a fan including a fan rotor and a plurality of fan blades. The fan rotor includes a plurality of slots. Each of the plurality of fan blades includes a root and a blade, and the root of each of the plurality of fan blades is received in one of the plurality of slots of the fan rotor. Each root includes a front surface, a rear surface, a first side surface connected to the front surface and the rear surface, and a second side surface connected to the front surface and the rear surface. The front surface engages the first side surface and the second side surface by one or more blunted surfaces, and the rear surface engages the first side surface and the second side surface by one or more blunted surfaces.

In a further non-limited embodiment of the foregoing turbine engine embodiment, the turbine engine may include a front surface and a rear surface that are substantially flat.

In a further non-limited embodiment of any of the foregoing turbine engine embodiments, the turbine engine may include a cross-section of the root taken substantially parallel to a bottom surface of the root including no angles.

In a further non-limited embodiment of any of the foregoing turbine engine embodiments, the turbine engine may include blunted surfaces having a radius.

In a further non-limited embodiment of any of the foregoing turbine engine embodiments, the turbine engine may include a radius that is between about 0.1 inch to about 0.6 inch.

In a further non-limited embodiment of any of the foregoing turbine engine embodiments, the turbine engine may include blunted surfaces that are an ellipse.

In a further non-limited embodiment of any of the foregoing turbine engine embodiments, the turbine engine may include blunted surfaces that are a chamfer.

In a further non-limited embodiment of any of the foregoing turbine engine embodiments, the turbine engine may include a front surface and a rear surface that are curved.

In a further non-limited embodiment of any of the foregoing turbine engine embodiments, at least one of the fan blades may be made of at least one of aluminum and titanium.

In a further non-limited embodiment of the foregoing turbine engine embodiments, the turbine engine may include a root including a portion having substantially parallel walls defining a width therebetween. A distance may be defined between an outer edge of the portion of the root and a line that extends substantially parallel to the outer edge. The line passes through a point where the front surface and a first blunted surface meet and a point where the rear surface and a second blunted surface meet. A ratio of the distance to the width is between about 0.15 to about 0.50.

These and other features of the present invention can be best understood from the following specification and drawings, the following of which is a brief description.

DETAILED DESCRIPTION OF THE PREFERRED EMBODIMENTS

Figure 1:
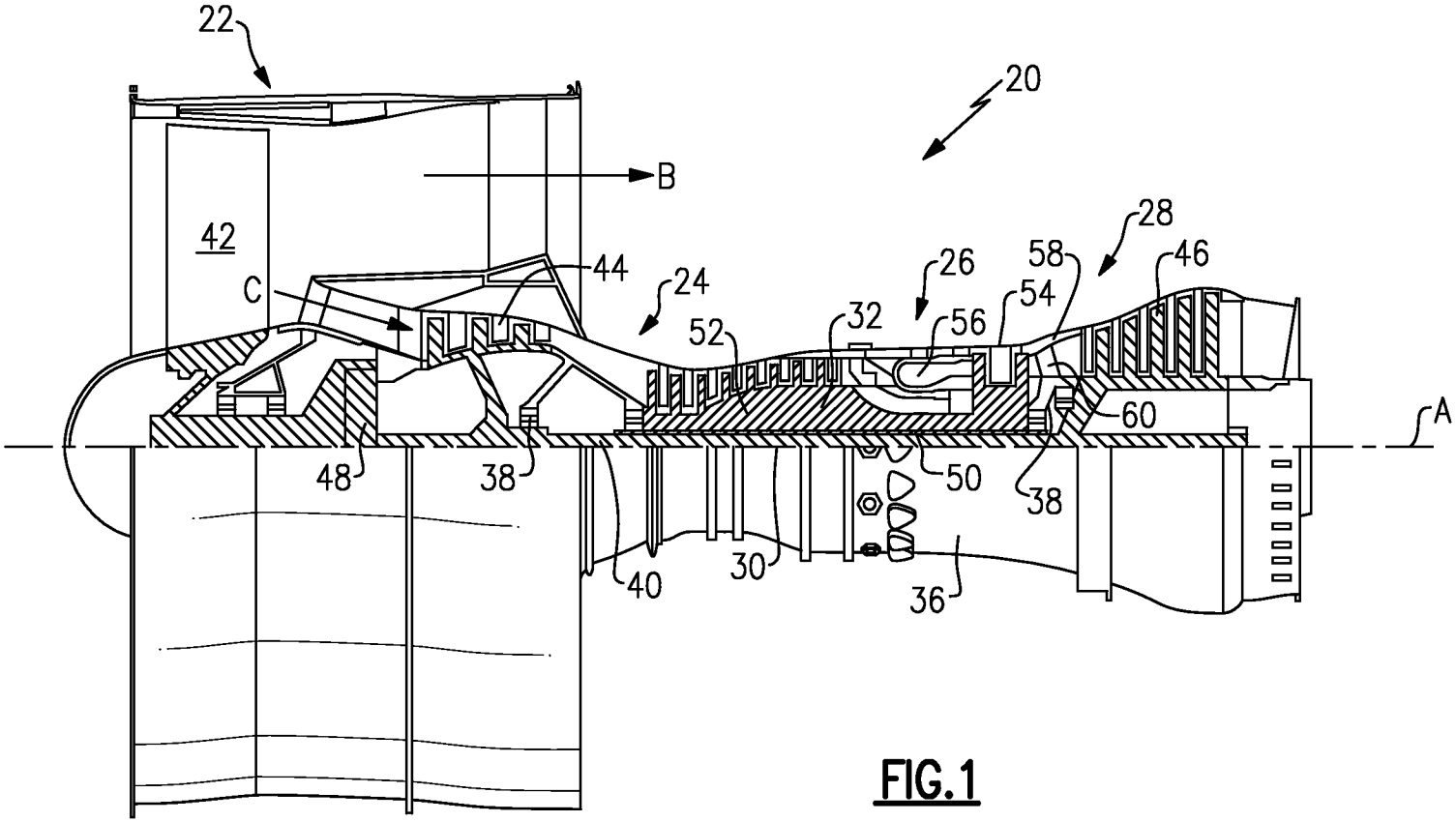
FIG. 1 illustrates a schematic view of an embodiment of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features.

Although depicted as a turbofan gas turbine engine in the disclosed non-limiting embodiment, it should be understood that the concepts described herein are not limited to use with turbofans as the teachings may be applied to other types of turbine engines including three-spool or geared turbofan architectures.

The fan section 22 drives air along a bypass flowpath B while the compressor section 24 drives air along a core flowpath C for compression and communication into the combustor section 26 then expansion through the turbine section 28.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and a high pressure turbine 54.

A combustor 56 is arranged between the high pressure compressor 52 and the high pressure turbine 54.

A mid-turbine frame 58 of the engine static structure 36 is arranged generally between the high pressure turbine 54 and the low pressure turbine 46. The mid-turbine frame 58 further supports bearing systems 38 in the turbine section 28.

The inner shaft 40 and the outer shaft 50 are concentric and rotate via bearing systems 38 about the engine central longitudinal axis A which is collinear with their longitudinal axes 6

The core airflow C is compressed by the low pressure compressor 44 then the high pressure compressor 52, mixed and burned with fuel in the combustor 56, then expanded over the high pressure turbine 54 and low pressure turbine 46. The mid-turbine frame 58 includes airfoils 60 which are in the core airflow path. The turbines 46, 54 rotationally drive the respective low speed spool 30 and high speed spool 32 in response to the expansion.

The engine 20 in one example a high-bypass geared aircraft engine. In a further example, the engine 20 bypass ratio is greater than about six (6:1) with an example embodiment being greater than ten (10:1). The geared architecture 48 is an epicyclic gear train (such as a planetary gear system or other gear system) with a gear reduction ratio of greater than about 2.3 (2.3:1). The low pressure turbine 46 has a pressure ratio that is greater than about five (5:1). The low pressure turbine 46 pressure ratio is pressure measured prior to inlet of low pressure turbine 46 as related to the pressure at the outlet of the low pressure turbine 46 prior to an exhaust nozzle.

In one disclosed embodiment, the engine 20 bypass ratio is greater than about ten (10:1), and the fan diameter is significantly larger than that of the low pressure compressor 44. The low pressure turbine 46 has a pressure ratio that is greater than about five (5:1). The geared architecture 48 may be an epicycle gear train, such as a planetary gear system or other gear system, with a gear reduction ratio of greater than about 2.5 (2.5:1). It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition-typically cruise at about 0.8 Mach and about 35,000 feet. The flight condition of 0.8 Mach and 35,000 feet, with the engine at its best fuel consumption, also known as bucket cruise Thrust Specific Fuel Consumption ("TSFC"). TSFC is the industry standard parameter of 1bm of fuel being burned divided by lbf of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.45.

"Low corrected fan tip speed" is the actual fan tip speed in feet per second divided by an industry standard temperature correction of $[(\text{Tambient deg R})/518.7)^{0.5}]$. The "Low corrected fan tip speed" as disclosed herein according to one non-limiting embodiment is less than about 1150 feet per second (351 meters per second).

Figure 2:
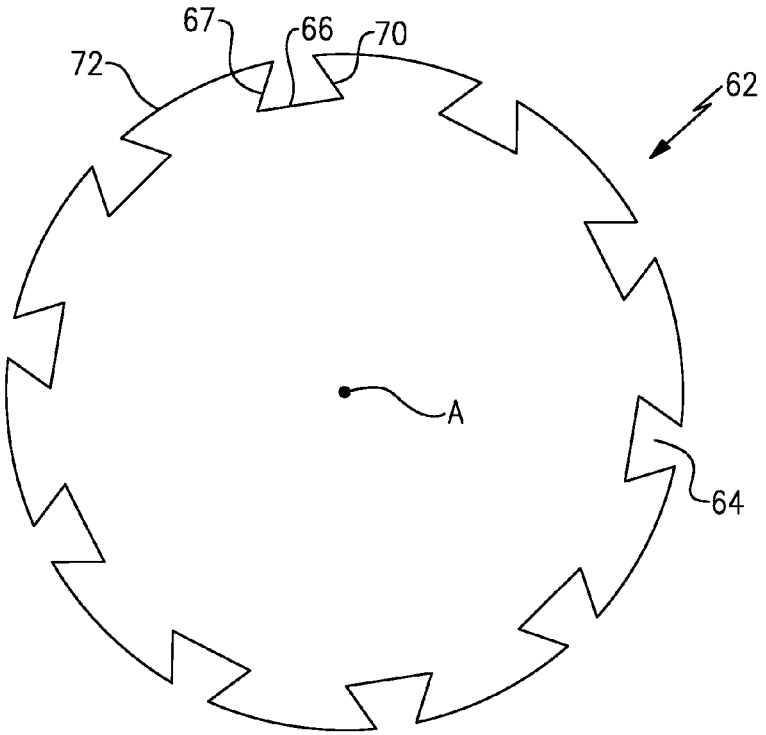
FIG. 2 illustrates a front view of an embodiment of a fan rotor.

As shown in FIG. 2, the fan 42 includes a fan rotor 62 that rotates about the longitudinal axis A. The fan rotor 62 includes a plurality of slots 64 that each receive a root 74 of a fan blade 68 (shown in FIG. 3). The slots 64 can be straight or curved. In one example, each slot 64 is substantially triangular in shape and includes a bottom surface 66, a first side surface 67, and a second side surface 70. The first side surface 67 and the second side surface 70 intersect with an outer surface 72 of the fan rotor 62.

Figure 3:
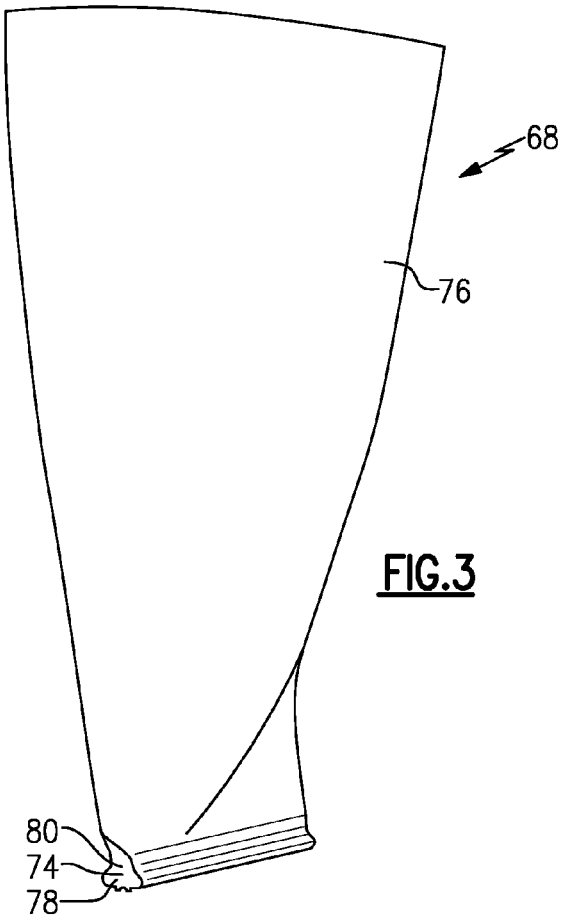
FIG. 3 illustrates a perspective view of an embodiment a fan blade.

FIG. 3 illustrates a perspective view of a fan blade 68. The fan blade 68 includes a root 74 and a blade 76.

Figure 4A:
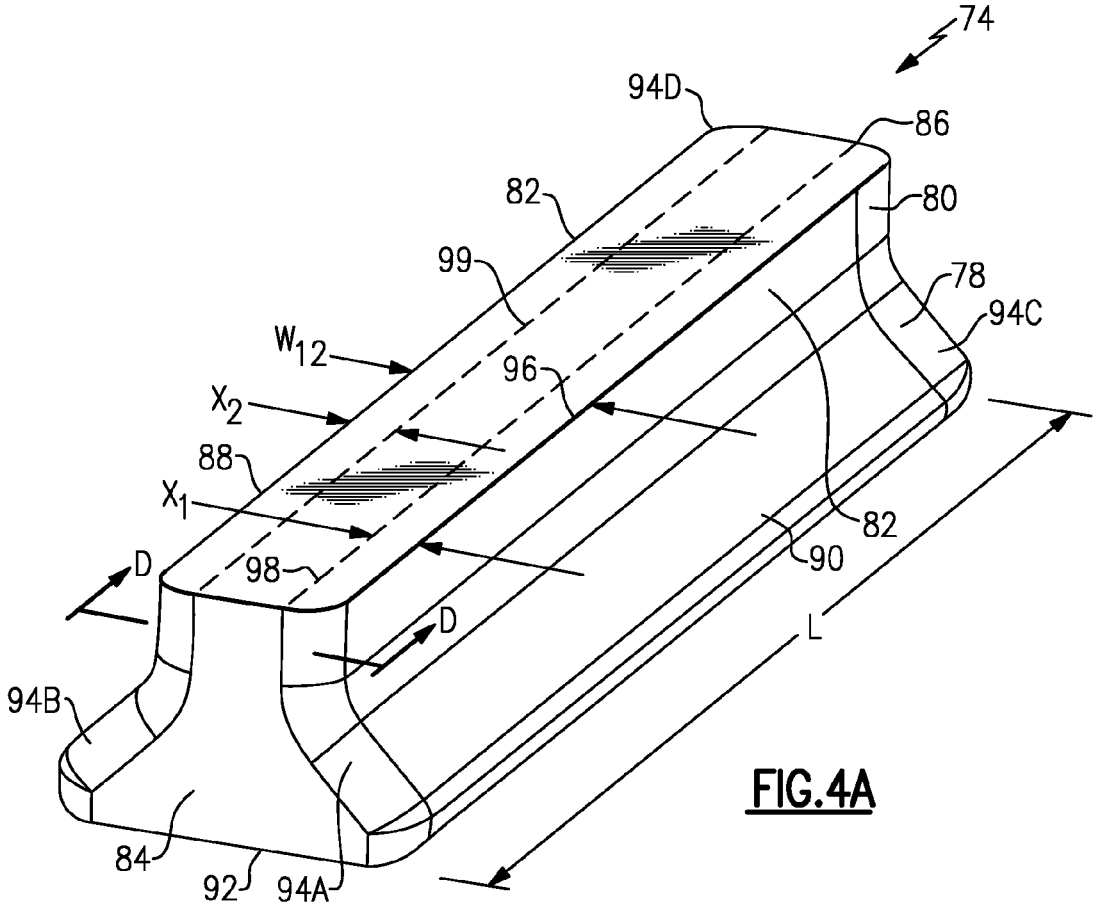
FIG. 4A illustrates a perspective view of a root of an embodiment of a fan blade.

FIG. 4A illustrates a root 74 of a first example fan blade 68. In one example, the fan blade 68 is made of aluminum. In another example, the fan blade 68 is a hollow aluminum fan blade. In another example, the fan blade 68 is made of titanium. In another example, the fan blade 68 is a hollow titanium fan blade.

The fan blade 68 includes a root 74 having a length L, a base 78 and an upper portion 80. The base 78 has a substantially triangular cross section, and the upper portion 80 is located above the base 78. The root 74 includes a front flat surface 84, a rear flat surface 86, first side surface 88 and a second side surface 90. In one example, the upper portion 80 of the root 74 includes walls 82 that are substantially parallel and separated by a width $W_{12}$. In another example, the side surfaces 88 and 90 are curved along the length L of the root 74, and curvature of the first side surface 88 corresponds to a curvature of the second side surface 90. In one example, the width $W_{12}$between the walls 82 is constant, and the root 74 has a dovetail shape. All four surfaces 84, 86, 88 and 90 define an outer wall and are connected to a bottom surface 92 to define the root 74.

First and second curved surfaces 94A, 94B are located between the front flat surface 84 and each of the first side surface 88 and the second side surface 90. Third and fourth curved surfaces 94C, 94D are located between the rear flat surface 86 and each of the first side surface 88 and the second side surface 90. The curved surfaces 94A-94D are completely or nearly rounded.

A distance $X_1$ is defined between an outer edge 96 of a wall 82 of the upper portion 80 of the root 74 and a line 98 (shown as a dashed line) that extends substantially parallel to the outer edge 96 that passes through both an uppermost point where the front flat surface 84 and the first curved surface 94A meet and an uppermost point where the rear flat surface 86 and the third curved surface 94C meet. A distance $X_2$ is defined between an outer edge 96 of a wall 82 of the upper portion 80 of the root 74 and a line 99 (shown as a dashed line) that extends substantially parallel to the outer edge 96 that passes through both an uppermost point where the front flat surface 84 and the second curved surface 94B meet and an uppermost point where the rear flat surface 86 and the fourth curved surface 94D meet.

In some embodiments, $X_1$ is substantially equal to $X_2$. A ratio of $X_1/W_{12}$ is approximately 0.3. Similarly, a ratio of $X_2/W_{12}$ is also approximately 0.3. In another example, the ratios are between about 0.15 and about 0.5. The ratios indicate an amount of curvature or degree of blunting in the area of transition from the one of the front flat surface 84 and the rear flat surface 86 to one of the side surfaces 88 and 90. Therefore, there is a significant amount of curvature of bluntness in these areas.

In prior roots of fan blades, a defined edge is located at the intersection of the side surfaces and each of the front surface and the rear surface. In the example of FIG. 4A, there is no edge between both the front surface and the rear surface and both the first side surface and the opposing second side surface, but instead curved surfaces 94A-94D.

Figure 4B:
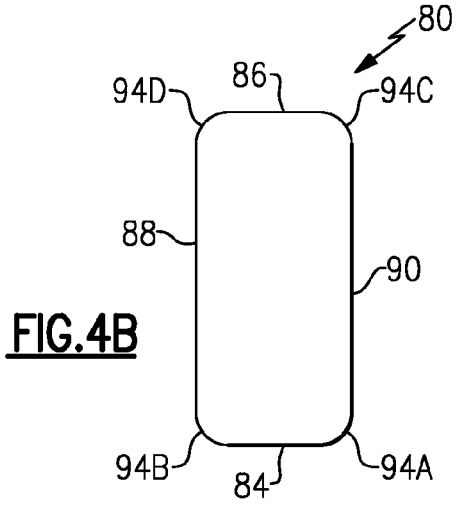
FIG. 4B illustrates a cross-section of the root of the fan blade of FIG. 4A taken along plane D-D.

FIG. 4B illustrates a cross-section of the upper portion 80 of the root 74 of FIG. 4A taken along a plane D-D substantially parallel to the bottom surface 92. At each of the end regions of the upper portion 80 of the root 74, a perimeter of the cross-section includes two curved surfaces separated by one of the front flat surface 84 and the rear flat surface 86. Therefore, the cross-section defines a perimeter that includes no angles or corners.

In one example, the curved surfaces 94A-94D each have a radius. In one example, the radius is about 0.1 to about 0.6 of an inch. In one example, the radius is about 0.375 of an inch. In another example, the curved surfaces 94A-94D are ellipses.

By eliminating sharp edges, the likelihood of any concentrated stress is greatly reduced. The curved surfaces 94A-94D allow aggressive surface treatments to be employed on the root 74, including deep-peening, low plasticity burnishing (LPB), or laser shock peening (LSP).

For example, when employing low plasticity burnishing, a compressive stress layer is applied on a surface of the root 74. A roller is run over the surface of the root 74 at a high pressure to compress the material of the root 74. By eliminating the edges between the front surface, the rear surface and the side surfaces, the roller can be employed to reduce the risk of damaging the root 74.

Figure 5A:
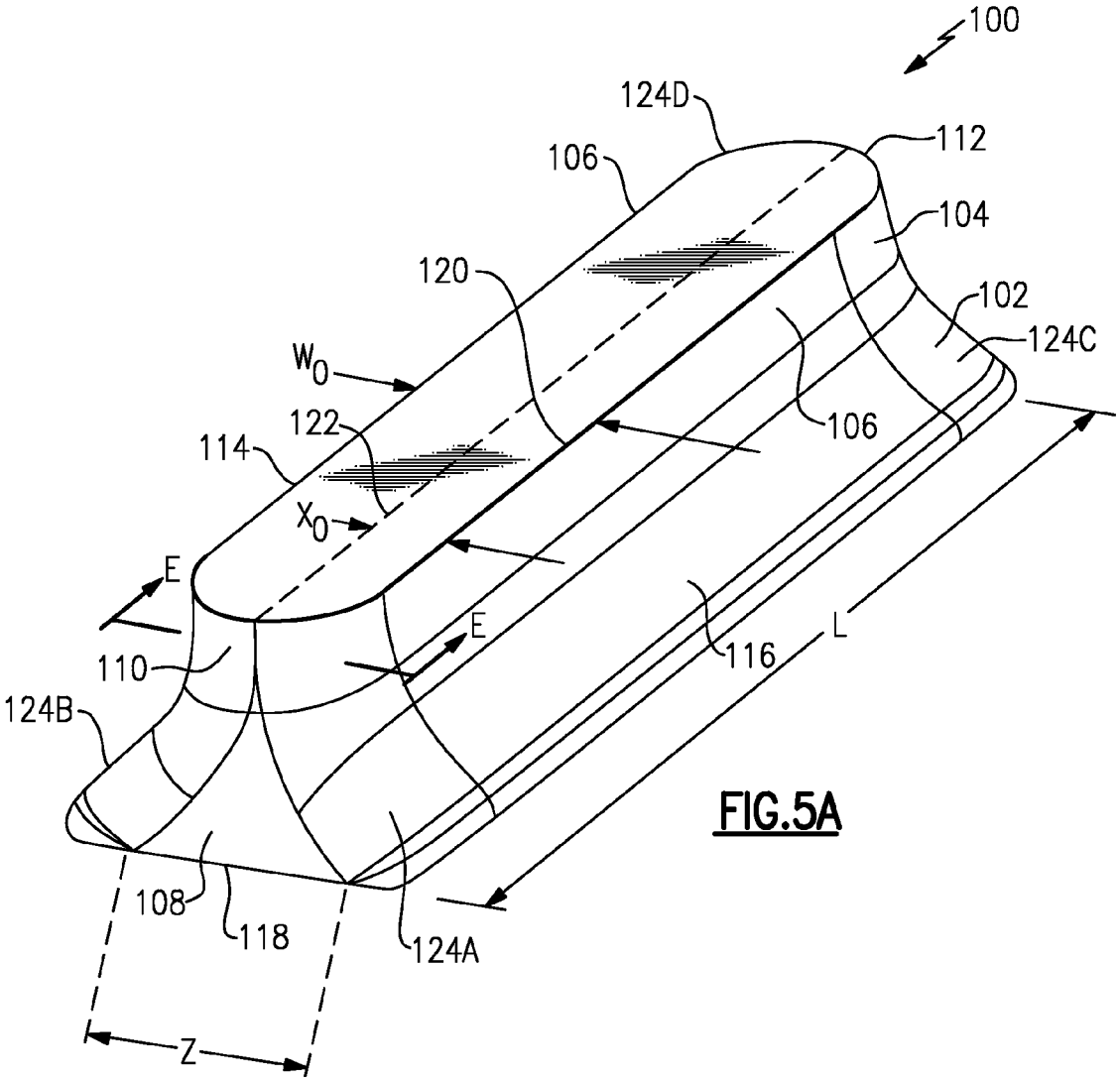
FIG. 5A illustrates a perspective view of a root of another embodiment of a fan blade.

FIG. 5A illustrates another example root 100 of the fan blade 68 having a length L, a base 102 and an upper portion 104. In one example, the upper portion 104 of the root 100 includes walls 106 that are substantially parallel and separated by a width $W_0$. In one example, the root 100 includes a front flat surface 108 and a rear flat surface (not shown but substantially similar to front flat surface 108) each having a width Z, but the upper portion 104 of the root 100 does not include any flat surfaces. In one example, a front area 110 and the rear area 112 of the upper portion 104 are both curved and are connected to side surfaces 114 and 116. In another example, the side surfaces 114 and 116 are curved along the length L of the root 100 and, the curvature of the first side surface 114 corresponds to the curvature of the second side surface 116. In one example, the width $W_0$ between the walls 106 is constant. All four surfaces 108, 114, 116 and rear flat surface (not shown) define an outer wall and are connected to a bottom surface 118 to define the root 100.

First and second curved surfaces 124A and 124B are located between the front flat surface 108 and each of the first side surface 114 and the second side surface 116. Third and fourth curved surfaces 124C and 124D are located between the rear flat surface (not shown) and each of the first side surface 114 and the second side surface 116. The curved surfaces 124A-124D are completely or nearly rounded. The curved surfaces 124A-124D are also a part of the upper portion 104 of the root 100. Two curved surfaces 124A, 124B define the front area 110 of the upper portion 104 of the root 100, and two curved surfaces 124C, 124D define the rear area 112 of the upper portion 104 of the root 100.

A distance $X_0$ is defined between an outer edge 120 of a wall 106 of the upper portion 104 of the root 100 and a line 122 (shown as a dashed line) that extends substantially parallel to the outer edge 120 of the upper portion 104 that passes through both a point defined by an intersection of the two curved surfaces 124A, 124B of the front area 110 and a point defined by the intersection the two curved surfaces 124C, 124D of the rear area 112. That is, the line 122 passes through a center of the width Z of the front flat surface 108 and the rear flat surface, which is not shown.

A ratio of $X_0/W_0$ is approximately 0.5. The ratio indicates an amount of curvature or degree of blunting in the area of transition from the one of the front area 110 and the rear area (not shown) to one of the side surfaces 114 and 116. Therefore, there is a significant amount of curvature of bluntness in this area.

Figure 5B:
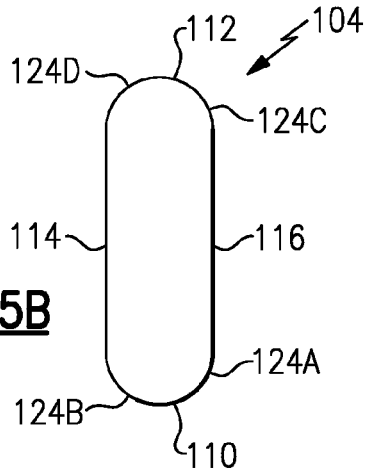
FIG. 5B illustrates a cross-section of the root of the fan blade of FIG. 5A taken along plane E-E.

FIG. 5B illustrates a cross-section of an upper portion 104 of the root 100 of FIG. 5A taken along a plane E-E substantially parallel to the bottom surface 118. At each of the front area 110 and the rear area 112 of the upper portion 104 of the root 100, a perimeter of the cross-section is completely curved and includes no angles or corners.

Figure 6A:
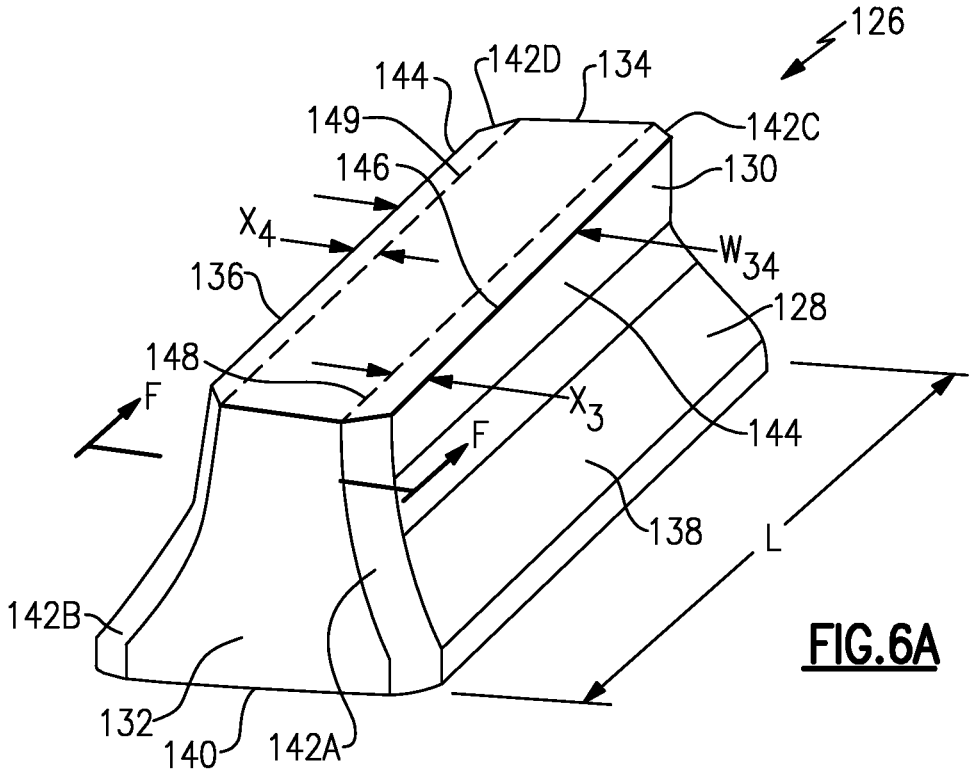
FIG. 6A illustrates a perspective view of a root of another embodiment of a fan blade.

FIG. 6A illustrates another example root 126 of the fan blade 68 having a length L, a base 128, and an upper portion 130. In one example, the upper portion 130 of the root 126 includes walls 144 that are substantially parallel and separated by a width $W_{34}$. In one example, the root 126 includes a front flat surface 132, a rear flat surface 134, a first side surface 136 and a second side surface 138. In another example, the side surfaces 136 and 138 can be curved along the length L of the root 126, and a curvature of the first side surface 136 corresponds to a curvature of the second side surface 138. In one example, the width $W_{34}$ between the walls 144 is constant. All four surfaces 132, 134, 136 and 138 define an outer wall and are connected to a bottom surface 140 to define the root 126.

In one example, first and second chamfered surfaces 142A, 142B are formed at an intersection of the front flat surface 132 and each of the adjacent side surfaces 136 and 138, and third and fourth chamfered surfaces 142C, 142D are formed at an intersection of the rear flat surface 134 and each of the adjacent side surfaces 136 and 138. In one example, the chamfered surfaces 142A-142D have a width of about 0.1 to about 0.6 of an inch.

A distance $X_3$ is defined between an outer edge 146 of the wall 144 of the upper portion 130 of the root 126 and a line 148 (shown as a dashed line) that extends substantially parallel to the outer edge 146 of the upper portion 130 that passes through both the point where the front flat surface 132 and the first chamfered surface 142A meet, and the point where the rear flat surface 134 and the third chamfered surface 142C meet. Therefore, there is a significant amount of curvature of bluntness in this area. A distance $X_4$ is defined between an outer edge 146 of a wall 144 of the upper portion 130 of the root 126 and a line 149 (shown as a dashed line) that extends substantially parallel to the outer edge 146 that passes through both the point where the front flat surface 132 and second chamfered curved surface 142B meet and the point where the rear flat surface 134 and the fourth chamfered surface 142D meet.

In some embodiments, $X_3$ is substantially equal to $X_4$. In one example, a ratio of $X_3/W_{34}$ is approximately 0.3. Similarly, a ratio of $X_4/W_{34}$ is also approximately 0.3. In another example, the ratios are between about 0.15 and about 0.5. The ratios indicate an amount of curvature or degree of blunting in the area of transition from the one of the front flat surface 84 and the rear flat surface 86 to one of the side surfaces 88 and 90. Therefore, there is a significant amount of bluntness in these areas.

Figure 6B:
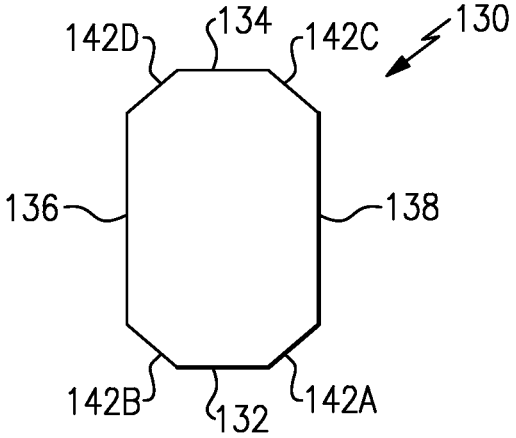
FIG. 6B illustrates a cross-section of the root of the fan blade of FIG. 6A taken along plane F-F.

FIG. 6B illustrates a cross-section of an upper portion 130 of the root 126 of FIG. 6A taken along a plane F-F substantially parallel to the bottom surface 140. A perimeter of the cross-section includes a flattened area at the location of the chambered surfaces 142A-142D.

The curved surfaces 94A-94D and 124A-124D and the chamfered surfaces 142A-142D are all blunted surfaces, which eliminate edges between adjacent surfaces. Thus, for purposes of the claims hereafter set forth, the term "blunted surfaces" includes both curved surfaces and chamfered surfaces.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A fan blade comprising:

a root including a front surface, a rear surface, a first side surface connected to the front surface and the rear surface, and a second side surface connected to the front surface and the rear surface, wherein a first front curved surface connects the front surface to the first side surface, a second front curved surface connects the front surface to the second side surface, a first rear curved surface connects the rear surface to the first side surface, and a second rear curved surface connects the rear surface to the second side surface, and the front surface is substantially perpendicular to both the first side surface and the second side surface, and the rear surface is substantially perpendicular to both the first side surface and the second side surface, and wherein, in a cross-section of the root taken in a plane perpendicular to all of the front surface, the rear surface, the first side surface, and the second side surface, the first front curved surface, the second front curved surface, the first rear curved surface, and the second rear curved surface are curved; and a blade extending from the root.

2. The fan blade as recited in claim 1 wherein the front surface and the rear surface are substantially flat.

3. The fan blade as recited in claim 1 wherein a cross-section of the root taken substantially parallel to a bottom surface of the root includes no angles.

4. The fan blade as recited in claim 1 wherein each of the curved surfaces has a radius.

5. The fan blade as recited in claim 4 wherein the radius is between about 0.1 inch to about 0.6 inch.

6. The fan blade as recited in claim 1 wherein each of the curved surfaces is an ellipse.

7. The fan blade as recited in claim 1 wherein the front surface and the rear surface are curved.

8. The fan blade as recited in claim 1 wherein the first side surface and the second side surface are substantially straight.

9. The fan blade as recited in claim 1 wherein the first side surface and the second side surface are substantially curved.

10. The fan blade as recited in claim 1 wherein the fan blade is made of at least one of aluminum and titanium.

11. The fan blade as recited in claim 1 wherein the root includes a portion having substantially parallel walls defining a width therebetween, a distance is defined between an outer edge of the portion of the root and a line that extends substantially parallel to the outer edge, the line passes through a point where the front surface and a first curved surface meet and a point where the rear surface and a second curved surface meet, and a ratio of the distance to the width is between about 0.15 to about 0.50.

12. The fan blade as recited in claim 1 including an axis extending from the root to the blade, and the curved surface is curved relative to the axis of the fan blade.

13. The fan blade as recited in claim 1 wherein the first side surface and the second side surface have a length that is greater than a width of the front surface and the rear surface.

14. The fan blade as recited in claim 1 wherein the first front curved surface directly connects the front surface to the first side surface, the second front curved surface directly connects the front surface to the second side surface, the first rear curved surface directly connects the rear surface to the first side surface, and a second rear curved surface directly connects the rear surface to the second side surface.

15. The fan blade as recited in claim 1 wherein the radius extends about a center line that is substantially parallel to the first side surface and the second side surface and substantially parallel to the front surface and the rear surface.

16. A turbine engine comprising:

a compressor section;

a combustor in fluid communication with the compressor section;

a turbine section in fluid communication with the combustor; and a fan including a fan rotor and a plurality of fan blades, wherein the fan rotor includes a plurality of slots, each of the plurality of fan blades includes a root and a blade, and the root of each of the plurality of fan blades is received in one of the plurality of slots of the fan rotor, wherein each root includes a front surface, a rear surface, a first side surface connected to the front surface and the rear surface, and a second side surface connected to the front surface and the rear surface, wherein a first front curved surface connects the front surface to the first side surface, a second front curved surface connects the front surface to the second side surface, a first rear curved surface connects the rear surface to the first side surface, and a second rear curved surface connects the rear surface to the second side surface, and the front surface is substantially perpendicular to both the first side surface and the second side surface, and the rear surface is substantially perpendicular to both the first side surface and the second side surface, and wherein, in a cross-section of the root taken in a plane perpendicular to all of the front surface, the rear surface, the first side surface, and the second side surface, the first front curved surface, the second front curved surface, the first rear curved surface, and the second rear curved surface are curved.

17. The turbine engine as recited in claim 16 wherein the front surface and the rear surface are substantially flat.

18. The turbine engine as recited in claim 16 wherein a cross-section of the root taken substantially parallel to a bottom surface of the root includes no angles.

19. The turbine engine as recited in claim 16 wherein each of the curved surfaces has a radius.

20. The turbine engine as recited in claim 19 wherein the radius is between about 0.1inch to about 0.6 inch.

21. The turbine engine as recited in claim 16 wherein each of the curved surfaces is an ellipse.

22. The turbine engine as recited in claim 16 wherein the front surface and the rear surface are curved.

23. The turbine engine as recited in claim 16 wherein at least one of the fan blades is made of at least one of aluminum and titanium.

24. The turbine engine recited in claim 16 wherein the root includes a portion having substantially parallel walls defining a width therebetween, a distance is defined between an outer edge of the portion of the root and a line that extends substantially parallel to the outer edge, the line passes through a point where the front surface and a first curved surface meet and a point where the rear surface and a second curved surface meet, and a ratio of the distance to the width is between about 0.15 to about 0.50.

25. The turbine engine as recited in claim 16 including an axis extending from the root to the blade, and the curved surface is curved relative to the axis of the fan blade.

26. The turbine engine as recited in claim 16 wherein the first side surface and the second side surface have a length that is greater than a width of the front surface and the rear surface.

27. The turbine engine as recited in claim 16 wherein the first front curved surface directly connects the front surface to the first side surface, the second front curved surface directly connects the front surface to the second side surface, the first rear curved surface directly connects the rear surface to the first side surface, and a second rear curved surface directly connects the rear surface to the second side surface.

28. The fan blade as recited in claim 16 wherein the radius extends about a center line that is substantially parallel to the first side surface and the second side surface and substantially parallel to the front surface and the rear surface.

* * * * *